US006474036B2

(12) United States Patent
Martin et al.

(10) Patent No.: US 6,474,036 B2
(45) **Date of Patent: *Nov. 5, 2002**

(54) RETAINING WALL BLOCK

(76) Inventors: James S. Martin, 3914 Fellsway Rd., Charlotte, NC (US) 28209; Curtis W. Shillingburg, 1714 Running Brook La., Rock Hill, SC (US) 29730

( * ) Notice: Subject to any disclaimer, the term of this patent is extended or adjusted under 35 U.S.C. 154(b) by 0 days.

This patent is subject to a terminal disclaimer.

(21) Appl. No.: 09/750,778

(22) Filed: Dec. 29, 2000

(65) Prior Publication Data

US 2001/0004822 A1 Jun. 28, 2001

Related U.S. Application Data

(63) Continuation of application No. 09/311,970, filed on May 14, 1999, now Pat. No. 6,168,354.

(51) Int. Cl.[7] ..... E04B 1/04; E02D 29/02

(52) U.S. Cl. ..... 52/604; 52/596; 52/592.6; 52/98; 405/284; 405/286

(58) Field of Search ..... 52/236.5, 236.4, 52/286, 503, 505, 575, 596, 747.12, 592.6, 98, 604, 100; 405/284, 286

(56) References Cited

U.S. PATENT DOCUMENTS

| | | | | | |
|---|---|---|---|---|---|
| D237,704 | S | * | 11/1975 | Lane | D25/1 |
| 4,123,881 | A | * | 11/1978 | Muse | 52/100 |
| 4,524,551 | A | * | 6/1985 | Scheiwiller | 52/98 |
| D280,024 | S | * | 8/1985 | Risi et al. | 405/16 |
| D295,788 | S | * | 5/1988 | Forsberg | 405/284 |
| 5,252,017 | A | | 10/1993 | Hodel | |
| 5,353,569 | A | * | 10/1994 | Rodrique | 52/589.1 |
| 5,490,363 | A | | 2/1996 | Woolford | |
| 5,505,034 | A | | 4/1996 | Dueck | |
| 5,653,558 | A | * | 8/1997 | Price | 405/284 |
| 5,704,183 | A | | 1/1998 | Woolford | |
| 5,709,062 | A | | 1/1998 | Woolford | |
| 5,711,129 | A | * | 1/1998 | Woolford | 52/604 |
| 5,795,105 | A | | 8/1998 | Guth | |
| 5,951,210 | A | | 9/1999 | Maguire et al. | |
| 5,992,108 | A | * | 11/1999 | Falcey | 52/220.2 |
| 6,082,067 | A | * | 7/2000 | Bott | 52/592.3 |

FOREIGN PATENT DOCUMENTS

| | | | | |
|---|---|---|---|---|
| DE | 888001 | * | 8/1953 | 52/604 |
| GB | 1385207 | * | 2/1975 | 52/604 |

* cited by examiner

*Primary Examiner*—Lanna Mai
*Assistant Examiner*—Phi Dieu Tran A
(74) *Attorney, Agent, or Firm*—Adams, Schwartz & Evans, P.A.

(57) ABSTRACT

A (modular wall block is adapted for being assembled together with a number of like blocks in stacked courses to form a retaining wall. The wall block includes a front face and rear, top and bottom, and opposing sides. A locking shear key extends outwardly from either of the top or bottom of the wall block, and is adapted for residing between respective adjacent sides of like blocks in an adjacent upper or lower course to anchor the wall block in position. A severable area is formed with the shear key for being removed to accommodate placement and orientation of the wall block between respective adjacent sides of like blocks in an adjacent upper or lower course.

19 Claims, 8 Drawing Sheets

RETAINING WALL BLOCK

TECHNICAL FIELD AND BACKGROUND OF INVENTION

This invention relates to a modular wall block and retaining wall constructed of an assembly of such blocks. The invention is particularly applicable for landscaping around residential or commercial structures to retain and preserve the surrounding soil while maintaining the aesthetics of the area. As a result of its relatively low cost, ease of manufacture and handling, concrete masonry block has emerged as one of the most popular and widely accepted material for use in constructing retaining walls. Such blocks are generally molded using standard molding systems common in the art.

Conventional retaining walls formed of concrete blocks are constructed in stacked courses with the upper courses typically setback to counter the pressure of the soil acting against the wall. Due to the geographic features of the area and often for aesthetic purposes, inward and outward curves are commonly formed in the wall. When constructing the wall, the blocks must be rotated through the curves in order to maintain proper orientation of the block faces. This presents a problem in some cases where protruding structure intended to help anchor the block in position after construction restricts its placement and movement relative to the adjacent blocks.

The present invention overcomes this and other problems of prior art wall blocks by providing a composite masonry wall block which is easy to handle and position when constructing a retaining wall. The invention includes structure which is readily removed in the field using conventional tools in order to properly orient the block relative to adjacent blocks.

SUMMARY OF THE INVENTION

Therefore, it is an object of the invention to provide a composite masonry wall block which is adapted for being assembled with like blocks to form a retaining wall.

It is another object of the invention to provide a composite masonry wall block which includes structure adapted for being removed from the block to facilitate its proper placement and orientation.

It is another object of the invention to provide a composite masonry wall block which is relatively inexpensive to manufacture.

It is another object of the invention to provide a composite masonry wall block which is relatively lightweight and easy to handle.

It is another object of the invention to provide a composite masonry wall block which has a desirable aesthetic appearance.

These and other objects of the present invention are achieved in the preferred embodiments disclosed below by providing a modular wall block adapted for being assembled together with a number of like blocks in stacked courses to form a retaining wall. The wall block includes a front face and rear, top and bottom, and opposing sides. A locking shear key extends outwardly from either of the top or bottom of the wall block, and is adapted for residing between respective adjacent sides of like blocks in an adjacent upper or lower course to anchor the wall block in position. A severable area is formed with the shear key for being removed to accommodate placement and orientation of the wall block between respective adjacent sides of like blocks in an adjacent upper or lower course.

According to one preferred embodiment, the shear key is generally V-shaped having center point directed towards the rear of the block, and first and second diverging ends extending forwardly towards the front face of the block and outwardly towards respective sides of the block.

According to another preferred embodiment of the invention, first and second severable areas are formed with respective ends of the shear key and are adapted for being removed during construction of a retaining wall to accommodate orientation of the wall block relative to respective adjacent sides of like blocks in an adjacent upper or lower course.

According to yet another preferred embodiment of the invention, the first and second severable areas formed with the shear key are defined by respective score lines.

According to yet another preferred embodiment of the invention, a front wall, the rear, and the opposing sides define a hollow center portion of the wall block.

According to yet another preferred embodiment of the invention, the sides taper inwardly from the front wall to the rear.

According to yet another preferred embodiment of the invention, the front face includes spaced-apart vertical breaks defining a center face portion and opposing side face portions.

According to yet another preferred embodiment of the invention, the center face portion has a rough, unfinished texture.

According to yet another preferred embodiment of the invention, the shear key is integrally formed with the block.

According to yet another preferred embodiment of the invention, the sides have severable areas adapted for being removed to receive a shear key of a like wall block arranged in an adjacent upper or lower course.

According to yet another preferred embodiment of the invention, the severable areas formed with the sides are defined by a plurality of vertical score lines.

In another embodiment, the invention is a retaining wall constructed of an assembly of like modular wall blocks arranged in stacked courses. Each of the wall blocks includes a front face and rear, top and bottom, and opposing sides. A locking shear key extends outwardly from either of the top or bottom of the wall block, and is adapted for residing between respective adjacent sides of like blocks in an adjacent upper or lower course to anchor the wall block in position. A severable area is formed with the shear key for being removed to accommodate placement and orientation of the wall block between respective adjacent sides of like blocks in an adjacent upper or lower course.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENTS AND BEST MODE

Figure 1:
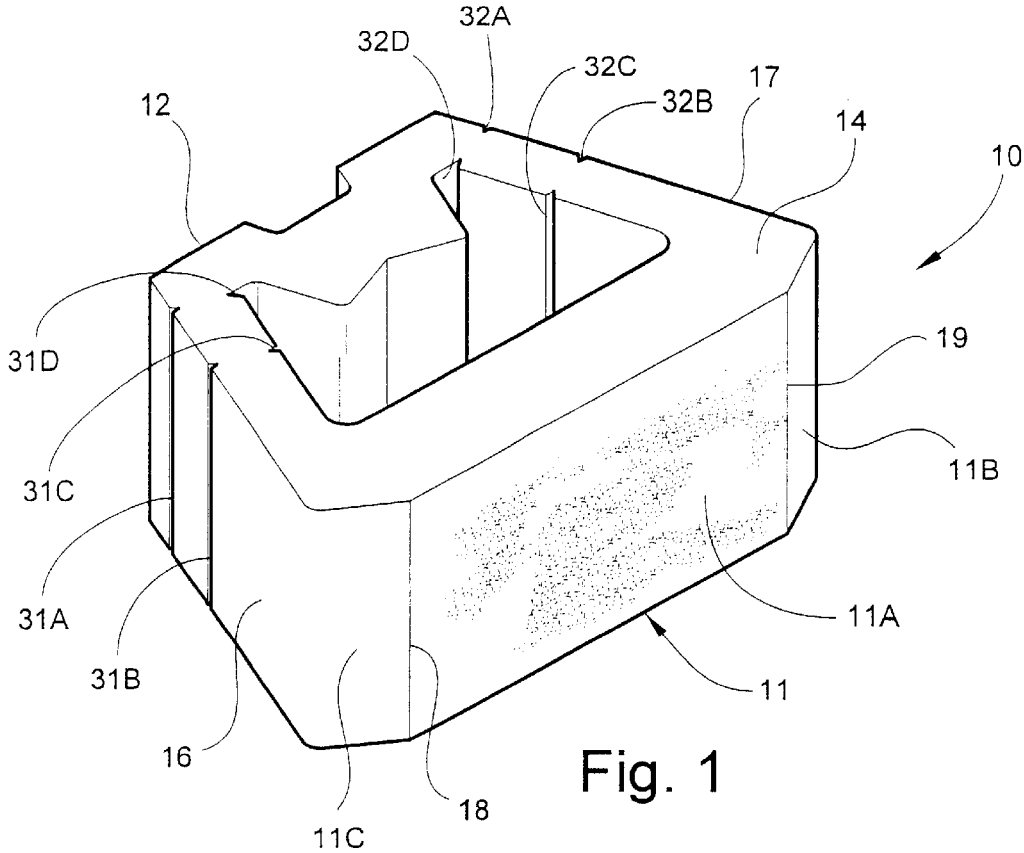
FIG. 1 is a top perspective view of the wall block according to one preferred embodiment of the invention.
Figure 2:
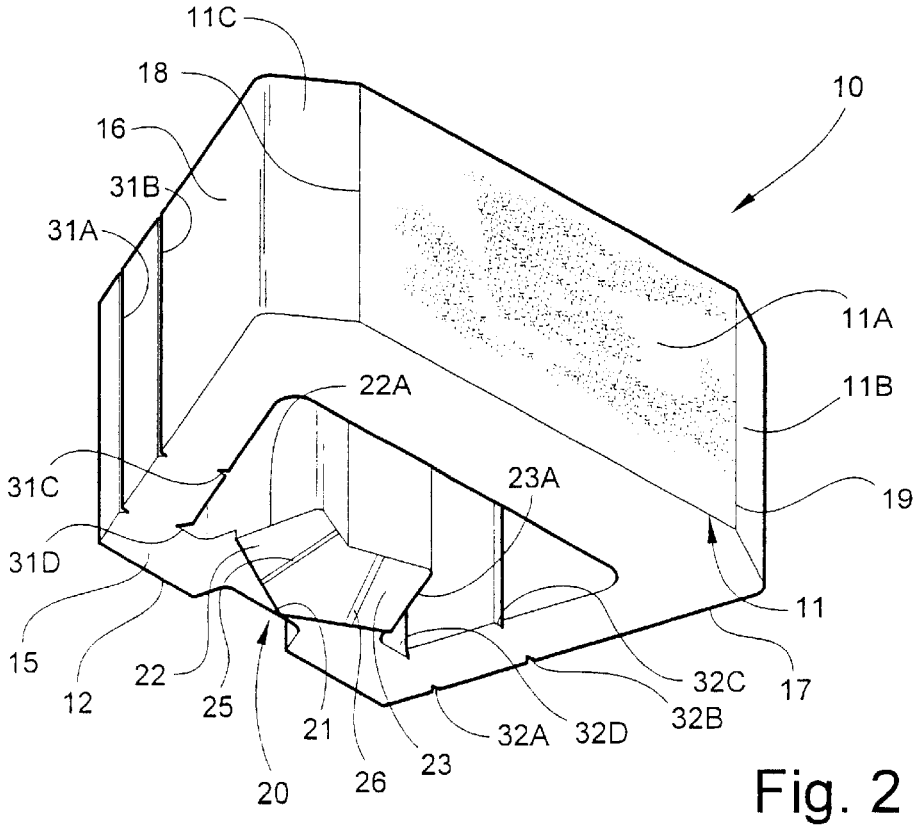
FIG. 2 is a bottom perspective view of the wall block.
Figure 3:
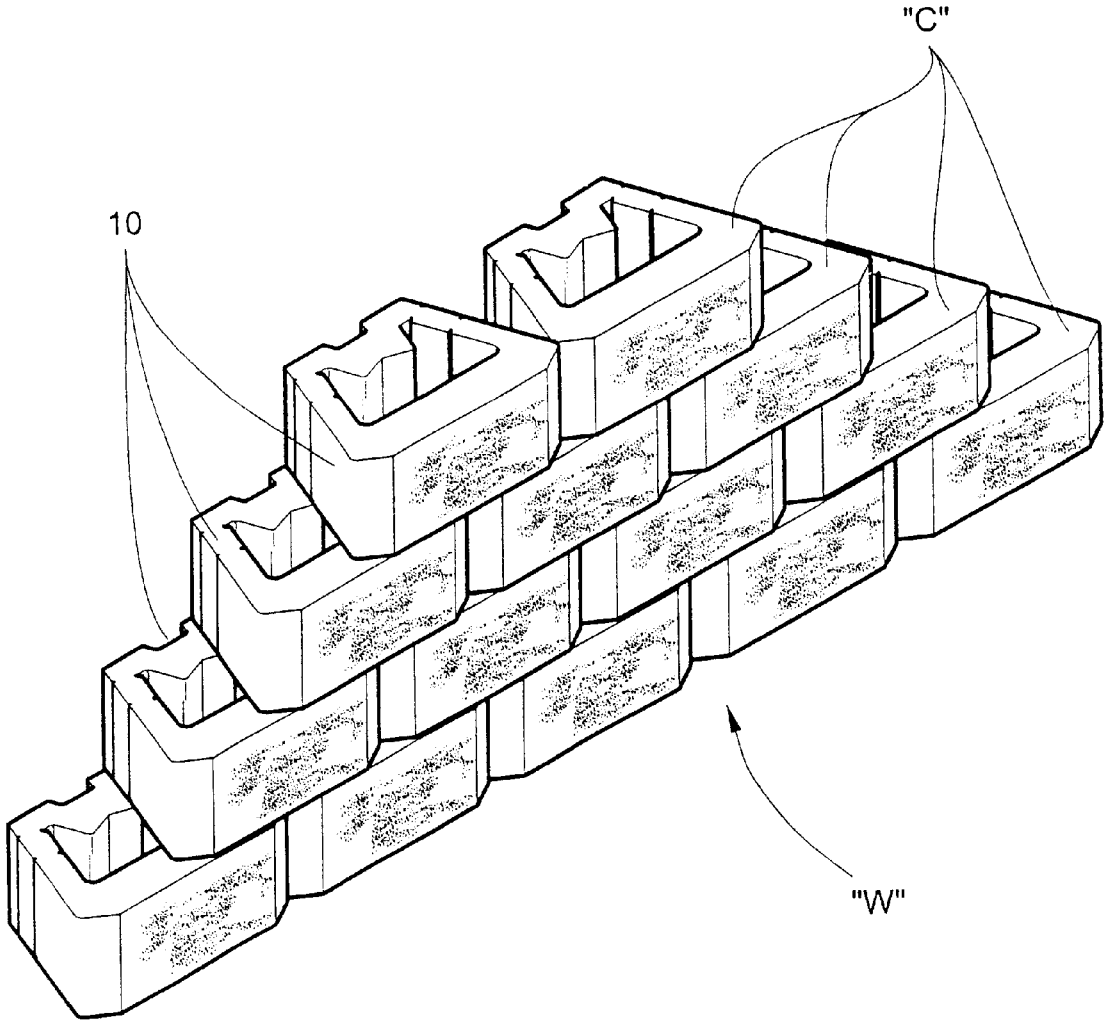
FIG. 3 is a perspective view of a partially constructed retaining wall using the wall blocks shown in FIGS. 1 and 2.

Referring now specifically to the drawings, a wall block according to the present invention is illustrated in FIGS. 1 and 2, and shown generally at reference numeral 10. As shown in FIG. 3, the wall block 10 is adapted for being assembled together with a number of like blocks in stacked courses "C" to form a retaining wall "W". The wall blocks 10 are preferably formed of molded masonry concrete.

Referring again to FIGS. 1 and 2, the wall block 10 has a front face 11 and rear 12, top 14 and bottom 15, and opposing sides 16 and 17. According to one embodiment, the front face 11 includes vertical breaks 18 and 19 defining a center face portion 11A and opposing side face portions 11B and 11C. Preferably, the center face portion 11A has an unfinished, rough textured surface to promote the aesthetic appearance of the wall block 10. The center of the wall block 10 is hollow to reduce the overall weight of the block 10, for convenient handling and placement of the block 10 during construction of the retaining wall "W".

Figure 4:
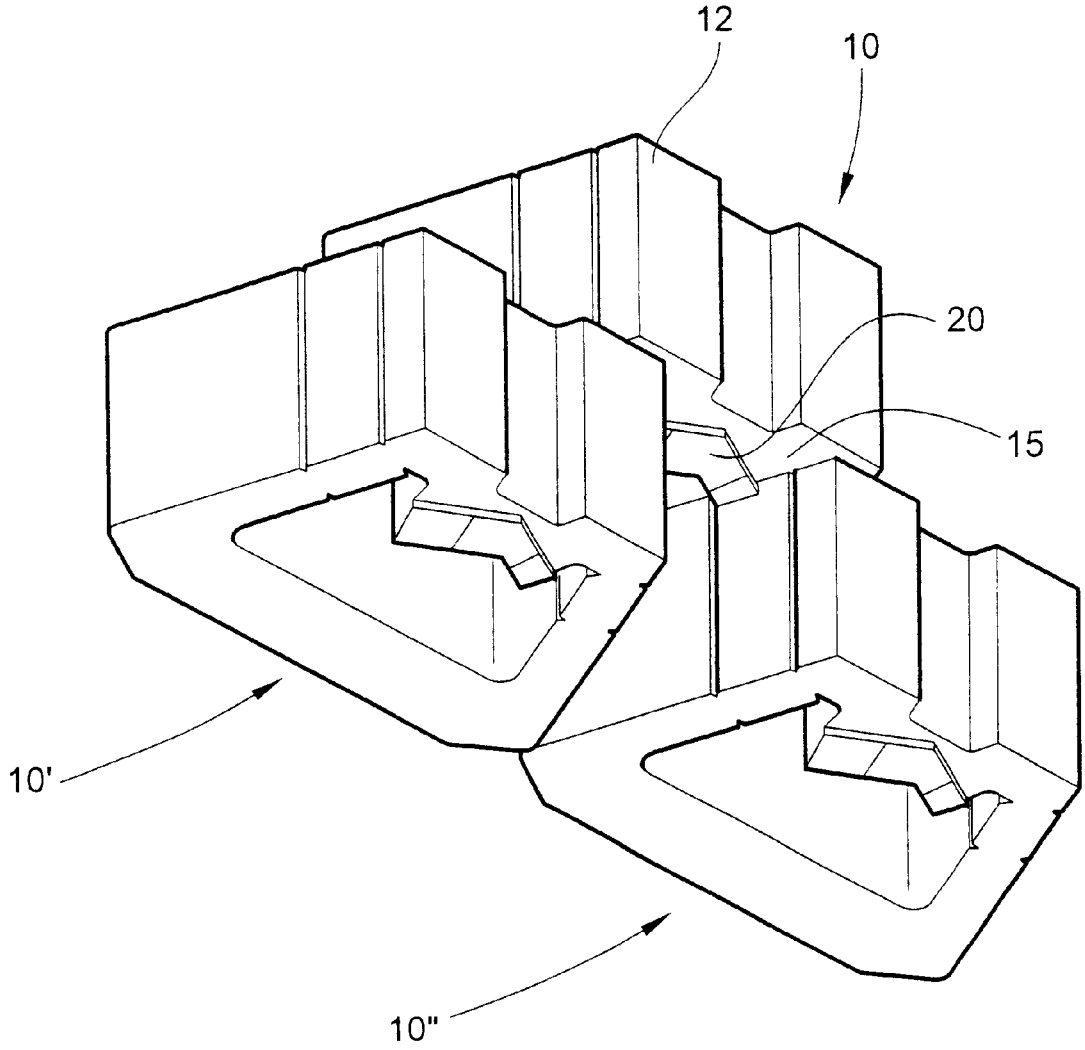
FIG. 4 is a bottom perspective view from the rear of wall blocks stacked in upper lower courses.

As best shown in FIGS. 2 and 4, a generally V-shaped locking shear key 20 is integrally formed with the wall block 10, and protrudes outwardly from the bottom 15 to fit between respective adjacent sides of identical blocks 10' and 10" arranged in a lower course (See FIG. 4). The shear key 20 is spaced inwardly from the back side of the block 10 and has a center point 21 directed towards the rear 12 of the block 10, and first and second diverging ends 22 and 23 extending forwardly towards the front face 11 and outwardly towards the sides 16 and 17. End edges 22A and 23A of the shear key 20 extend generally parallel to respective opposite sides 16 and 17 of the block 10. Thus, end edge 22A extends generally parallel to side 17, whereas end edge 23A extends generally parallel to side 16.

Figure 5:
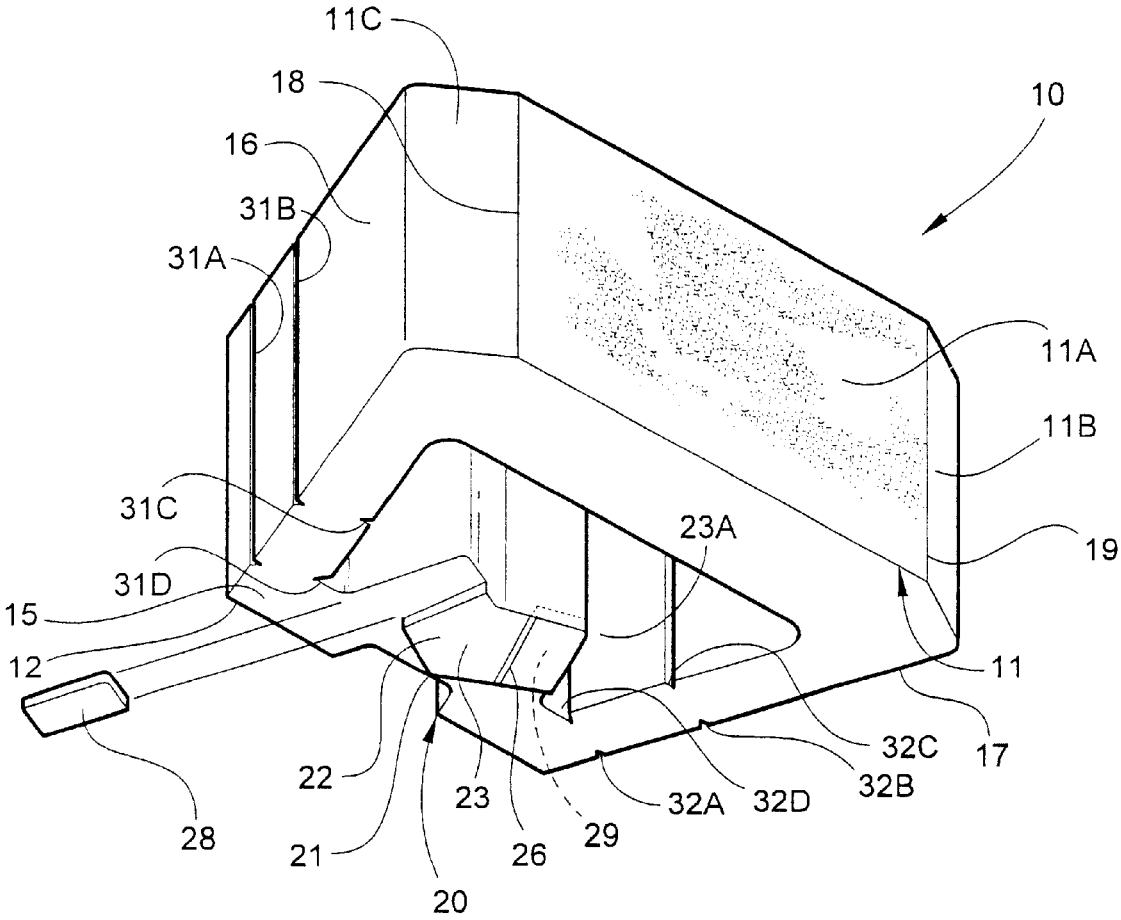
FIG. 5 is a bottom perspective view of the wall block showing one of the severable areas of the shear key removed.
Figure 6:
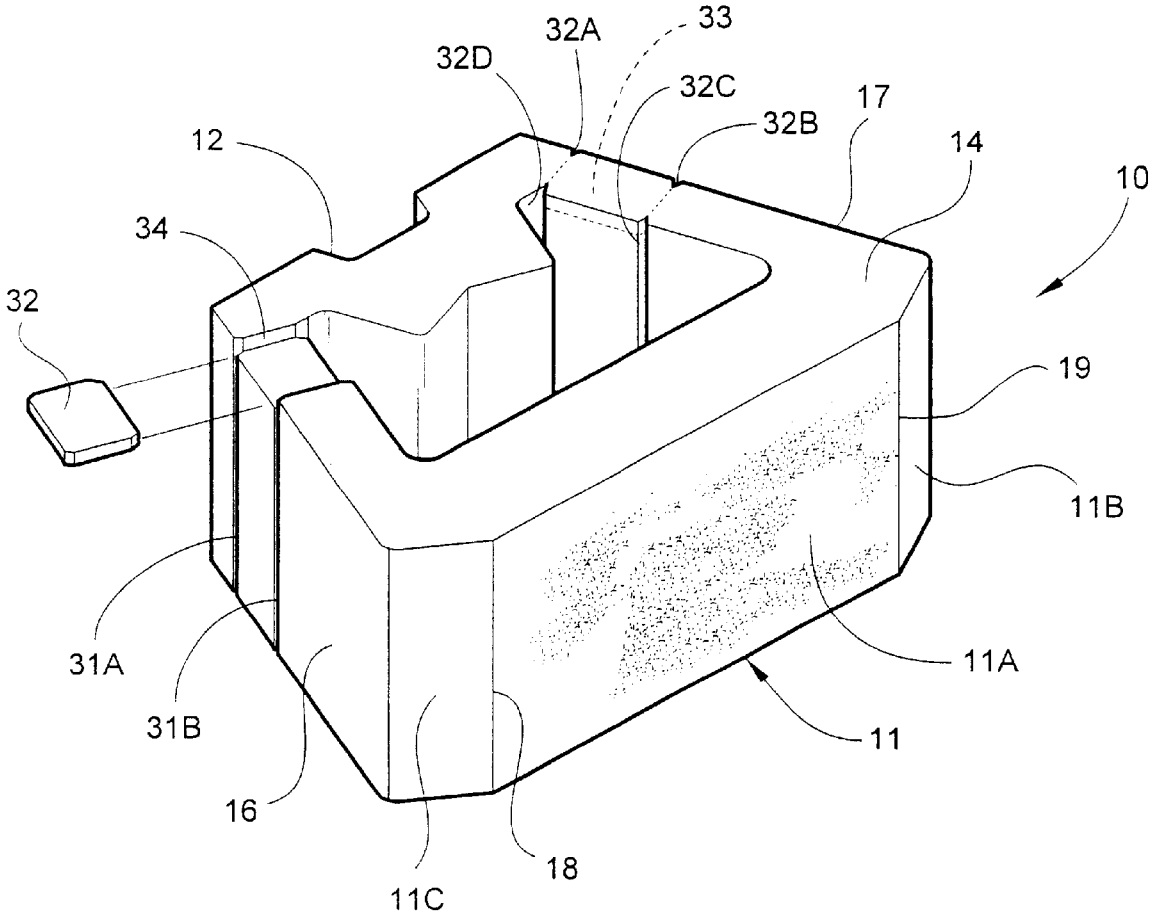
FIG. 6 is a top perspective view of the wall block showing one of the severable areas of the side removed.

Score lines 25 and 26 define respective severable areas 28 and 29, as shown in FIG. 5, which are conveniently removed, if necessary, during construction of the retaining wall "W" in order to properly position and orient the wall block 10 relative to the adjacent blocks 10' and 10". The severable areas 28 and 29 are typically removed with a hammer or other suitable tool. Preferably, the sides 16 and 17 of the wall block 10 include additional score lines 31A–31D and 32A–32D defining severable areas 32 and 33 along respective top side edges of the block 10. These areas 32, 33 can also be easily removed, as shown in FIG. 6, to form indents 34 (only one shown) for receiving ends of shear keys 20. The indents 34 cooperate with the shear keys 20 to further facilitate proper orientation of the stacked wall blocks 10, particularly when forming inward or outward curves in the retaining wall "W".

FIGS. 7A–7E demonstrate various arrangements of stacked wall blocks 10, 10', and 10" according to the present invention. Like elements are indicated in prime (') and double prime (") notation, respectively.

Figure 7A:
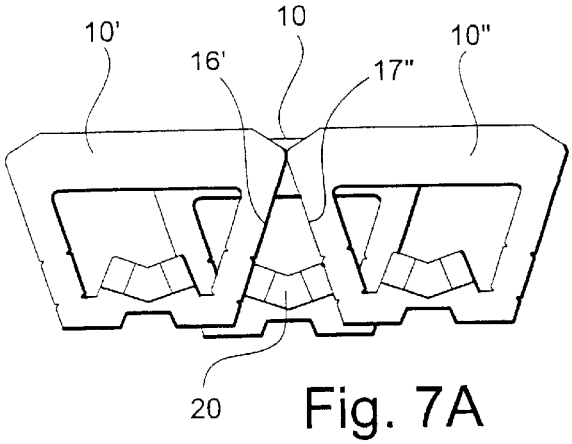
FIGS. 7A–7E are bottom plan views showing various arrangements of the wall blocks.
Figure 7D:
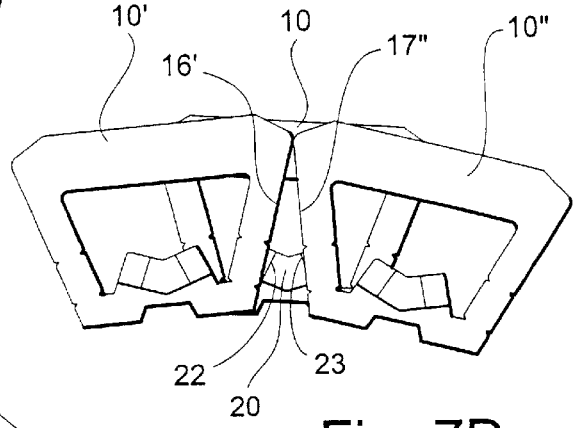
Figure 7B:
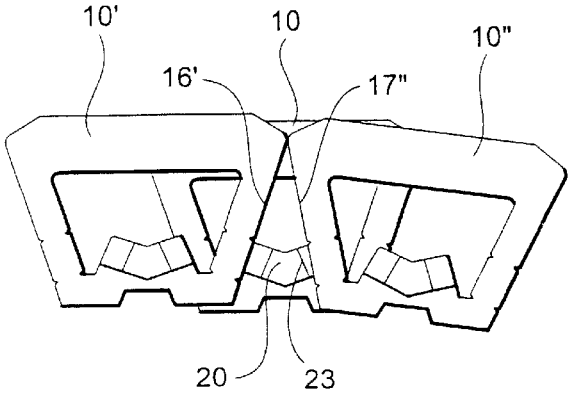
Figure 7E:
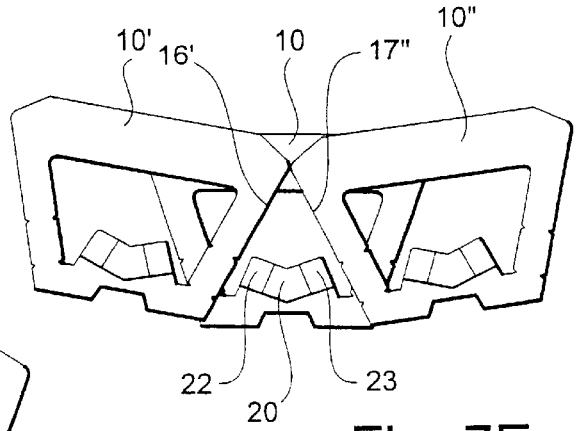
Figure 7C:
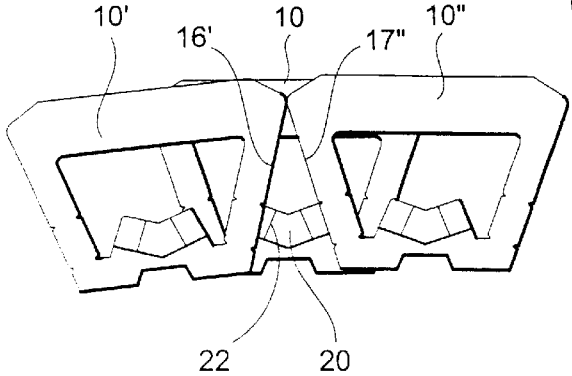

In FIG. 7A, the ends of the shear key 20 of block 10 are squared to the sides 16' and 17" of the two stacked blocks 10' and 10". The shear key 20 is wedged between the blocks 10' and 10" and operates to help secure and stabilize the resulting wall. Ends edges 22A and 23A of the shear key 20 engage the sides 16' and 17", respectively, at engagement areas. Blocks laid according to this arrangement form upper and lower courses extending in a generally straight path. In FIG. 7B, one end 23 of the shear key 20 is removed at the severable area 29 (See FIG. 5) to permit slight rotation of the block 10 inwardly to form an outward curve in the retaining wall. Alternatively, an edge portion of the side 17" of the block 10" at the severable area 32" (See FIG. 6) may be easily removed to receive the end 23 of the shear key 20. In FIG. 7C, the opposite end 22 of the shear key 20 of block 10 is removed at the severable area 28 (See FIG. 5) to permit slight inward rotation of the block 10. In FIG. 7D, both ends 22 and 23 of the shear key 20 of block 10 are removed to increase the outward curvature of the retaining wall. Alternatively, respective side edges 16' and 17" of blocks 10' and 10" may be removed at their respective severable areas 33' and 32" (See FIG. 6), as previously described, to receive the ends 22 and 23 of shear key 20. In FIG. 7E, the blocks 10' and 10" are rotated slightly outwardly relative to the block 10 in order to form an inner curve in the retaining wall. According to this arrangement, none of the severable areas are removed.

FIGS. 7A–7E demonstrate various arrangements of stacked wall blocks 10, 10', and 10" according to the present invention. Like elements are indicated in prime (') and double prime (") notation, respectively.

Figure 8:
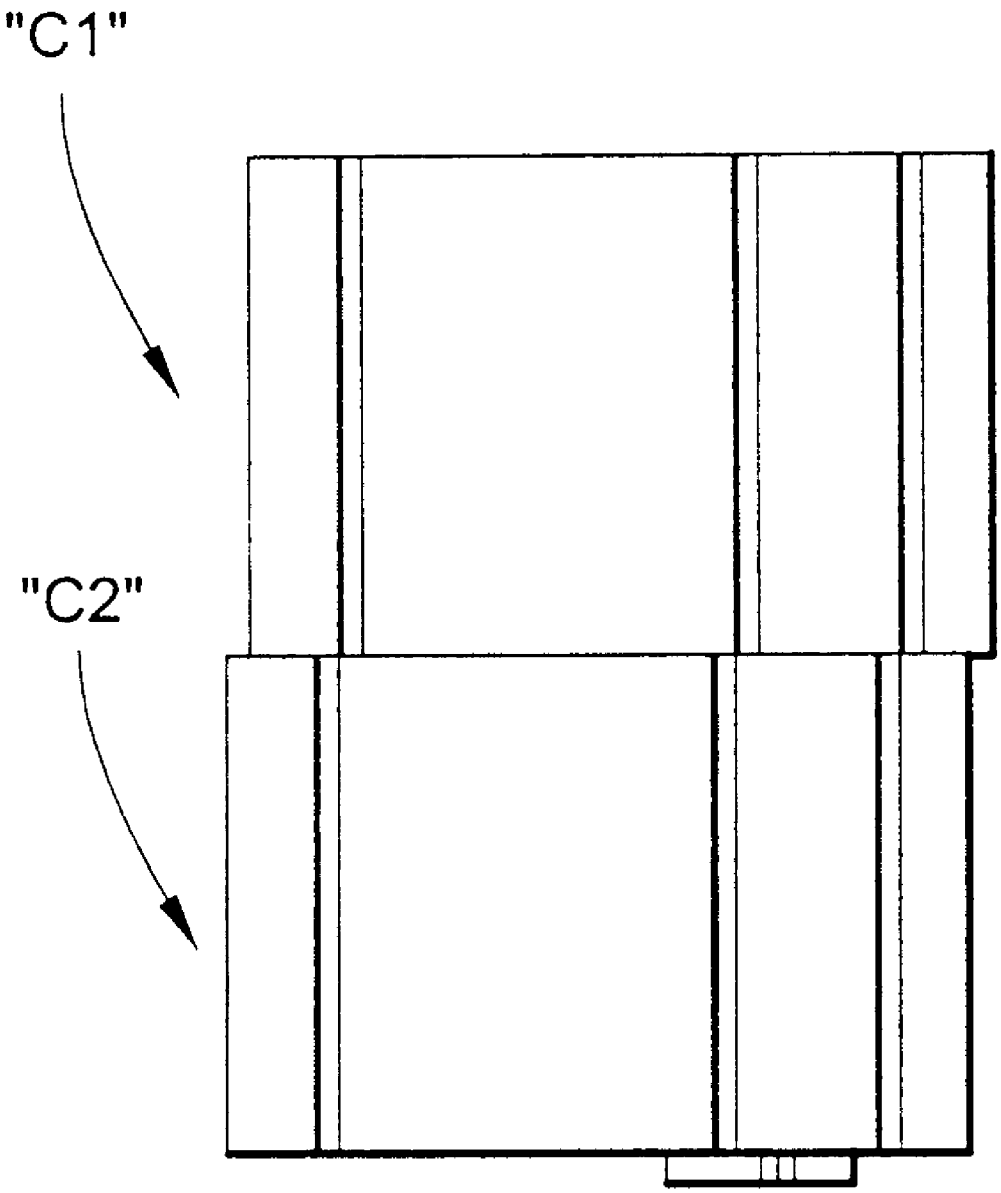
FIG. 8 is a side elevation of two courses of wall blocks with the upper course spaced slightly back from the lower course.

The upper course of wall blocks "C1" is preferably spaced slightly back from the lower course "C2" as shown in FIG. 8. Alternatively, however, the upper course "C1" may be positioned either directly on top of the lower course "C2", or spaced slightly forward of the lower course "C2". A geogrid mat, typically positioned between the blocks and extending into the wall backfill, is used to further retain the soil behind the wall.

Figure 9:
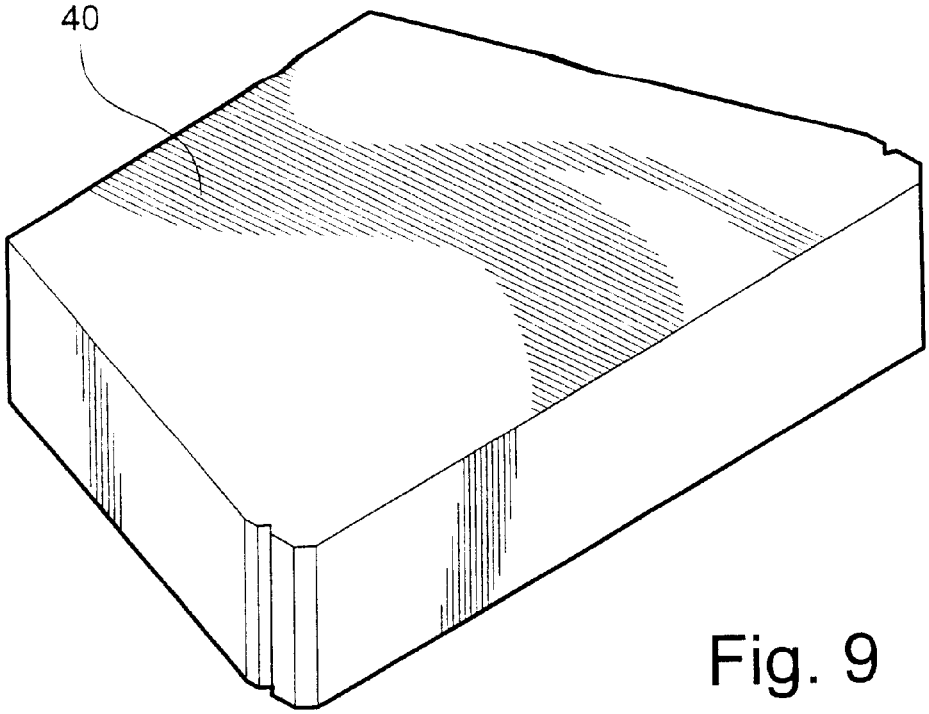
Figure 10:
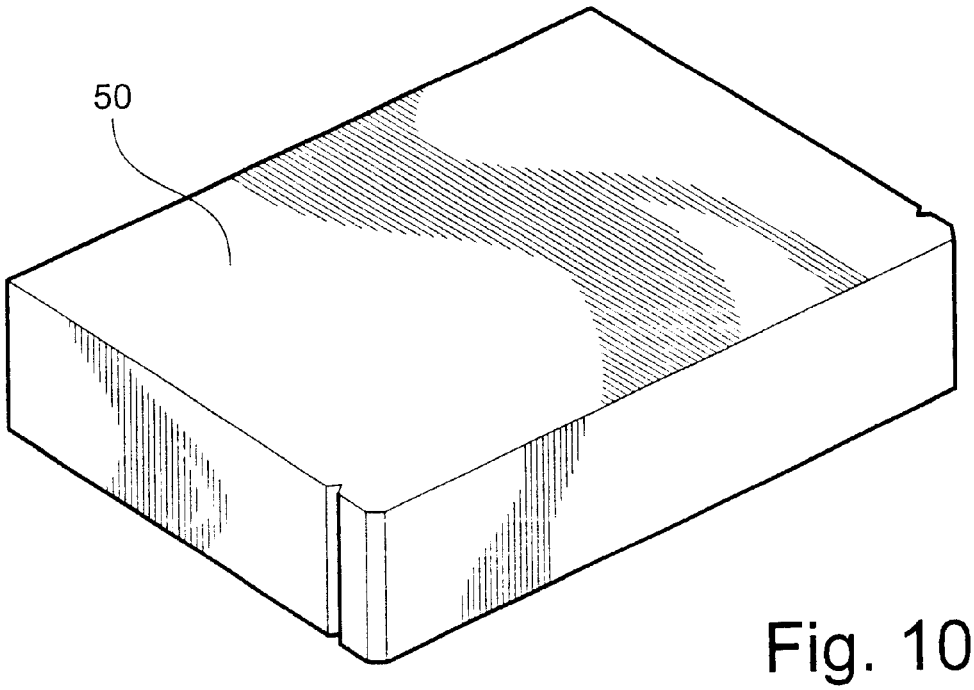
FIG. 10 is a perspective view of another embodiment of a wall cap.

Preferably, after assembling the wall blocks 10 as described above, a course of molded concrete wall caps are placed over the top course of blocks to finish the retaining wall. FIGS. 9 and 10 illustrate separate embodiments of suitable wall caps 40 and 50, respectively.

A modular wall block and retaining wall are described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

We claim:

1. A modular wall block adapted for being assembled together with a number of like blocks in stacked courses to form a retaining wall, said wall block comprising:

(a) a front face and rear, top and bottom, and opposing sides, the opposing sides tapering inwardly from the front face to the rear and defining respective engagement areas extending along generally straight and continuous edge portions of said block;

(b) a locking shear key extending outwardly from at least one of the top and bottom of said wall block, and spaced inwardly from said opposing sides, front face, and rear of said block, said shear key adapted for residing between and engaging respective adjacent engagement areas of like blocks in an adjacent upper or lower course to anchor said wall block in position; and (c) wherein said shear key defines respective end edges each being formed generally parallel to a far engagement area of said block.

2. A wall block according to claim 1, and comprising first and second severable areas formed with said shear key.

3. A wall block according to claim 2, wherein said first and second severable areas formed with said shear key are defined by respective score lines.

4. A wall block according to claim 1, wherein a front wall, the rear, and the opposing sides define a hollow center portion of said wall block.

5. A wall block according to claim 1, wherein said front face comprises spaced-apart vertical breaks defining a center face portion and opposing side face portions.

6. A wall block according to claim 5, wherein said center face portion has a rough, unfinished texture.

7. A wall block according to claim 1, wherein said shear key is integrally formed with said block.

8. A wall block according to claim 1, wherein said sides comprise respective severable areas adapted for being removed to receive a shear key of a like wall block arranged in an adjacent upper or lower course.

9. A wall block according to claim 8, wherein the severable areas formed with said sides are defined by a plurality of vertical score lines.

10. A wall block according to claim 1, and comprising a severable area formed with said shear key for being removed to accommodate placement and orientation of said wall block between respective adjacent sides of like blocks in an adjacent upper or lower course.

11. A retaining wall constructed of an assembly of like modular wall blocks arranged in stacked courses, each of said wall blocks comprising:

(a) a front face and rear, top and bottom, and opposing sides, the opposing sides tapering inwardly from the front face to the rear and defining respective engagement areas extending along generally straight and continuous edge portions of said block;

(b) a locking shear key extending outwardly from one of the top and bottom of said wall block, and spaced inwardly from said opposing sides, front face, and rear of said block, said shear key adapted for residing between and engaging respective adjacent engagement areas of like blocks in an adjacent upper or lower course to anchor said wall block in position; and (c) wherein said shear key defines respective end edges each being formed generally parallel to a far engagement area of said block.

12. A retaining wall according to claim 11, and comprising first and second severable areas formed with respective ends of said shear key and adapted for being removed during construction of said retaining wall to accommodate orientation of said wall block relative to respective adjacent sides of like blocks in an adjacent upper or lower course.

13. A retaining wall according to claim 12, wherein said first and second severable areas formed with said shear key are defined by respective score lines.

14. A retaining wall according to claim 11, wherein, a front wall, the rear, and tie opposing sides define a hollow center portion of said wall block.

15. A retaining wall according to claim 11, wherein the front face of said wall block comprises spaced-apart vertical breaks defining a center face portion and opposing side face portions.

16. A retaining wall according to claim 15, wherein the center face portion of said wall block has a rough, unfinished texture.

17. A retaining wall according to claim 11, wherein said shear key is integrally formed with said block.

18. A retaining wall according to claim 11, wherein the sides of said wall block comprise respective severable areas adapted for being removed to receive a shear key of a like wall block arranged in an adjacent upper or lower course.

19. A retaining wall according to claim 11, and comprising a severable area formed with said shear key for being removed to accommodate placement and orientation of said wall block between respective adjacent sides of like blocks in an adjacent upper or lower course.

* * * * *